United States Patent [19]

King et al.

[11] 4,275,825

[45] Jun. 30, 1981

[54] CLAMP-ON TUBE HOLDER AND METHOD

[75] Inventors: Patrick D. King, Rantoul; Gary R. Folk, Urbana, both of Ill.

[73] Assignee: Flo-Con Systems, Inc., Champaign, Ill.

[21] Appl. No.: 89,615

[22] Filed: Oct. 29, 1979

[51] Int. Cl.[3] ..... B22D 41/08

[52] U.S. Cl. ..... 222/590; 222/606; 222/600; 285/373

[58] Field of Search ..... 285/365, 366, 367, 373, 285/419; 222/600, 606, 607, 567, 590

[56] References Cited

U.S. PATENT DOCUMENTS

| | | | |
|---|---|---|---|
| 3,627,353 | 12/1971 | Blumfeld et al. | 285/373 X |
| 3,841,539 | 10/1974 | Shapland, Jr. et al. . | |
| 4,091,861 | 5/1978 | Thalmann et al. | 222/607 X |
| 4,131,220 | 12/1978 | Bode, Jr. et al. | 222/607 |

FOREIGN PATENT DOCUMENTS

| | | | |
|---|---|---|---|
| 874886 | 7/1971 | Canada | 222/607 |
| 909293 | 9/1972 | Canada | 285/373 |
| 2621557 | 4/1977 | Fed. Rep. of Germany | 222/607 |
| 1157818 | 7/1969 | United Kingdom | 222/606 |

*Primary Examiner*—David A. Scherbel
*Attorney, Agent, or Firm*—Jack E. Dominik

[57] ABSTRACT

A clamp-on tube holder for use in teeming metal is disclosed having a slotted tube holder band and a toggle assembly which biases the slot for clamping the tube holder onto the nozzle of a ladle. Independently, a yoke is engaged with the tube holder, and a handle engaged with a socket on the toggle for remotely clamping the same. The method contemplates providing a toggle mechanism and clamp and a support yoke, with the support yoke pivotally secured to a fulcrum for manipulating the clamping mechanism and holding the same in place while the toggle is activated to clamp.

7 Claims, 6 Drawing Figures

CLAMP-ON TUBE HOLDER AND METHOD

FIELD OF INVENTION

The present invention relates to the teeming of metal, and more particularly stream control by applying a tube extension to a ladle gate valve of the character shown in U.S. Pat. No. 4,063,668.

SUMMARY OF THE PRIOR ART

The prior art is exemplified by U.S. Pat. No. 4,063,668, the environment disclosed therein, and the desirability of extending the nozzle of a ladle gate valve for stream control, and also for submerged pouring.

Usually in applying extensions for stream control by means of a depending tube, screw fastenings may be employed to insert the tube in the valve. In other instances, bayonet fasteners have been employed. In order to make these attachments, however, the ladle usually is positioned on its side, and is out of use and does not contain metal at a teeming temperature. In the event a tube extension is to be applied to a ladle gate valve while the ladle contains molten steel, the extension must be applied remotely as safety practices prohibit an operator from positionining himself beneath a ladle containing molten metal. The prior art type extensions described above cannot be safely secured under these conditions.

SUMMARY OF INVENTION

The invention is directed to a clamp-on tube holder which can be operated from a stand or platform adjacent a ladle, the clamp having a collar ring which supports the upper collar of the tube and is positioned beneath the ladle by means of a long handle having an assembly yoke on one end which engages the tube holder at its lower portion. The tube clamp is slotted, and has a toggle assembly biasing the slot with an extension which can be engaged by a remotely positioned arm.

When the tube is positioned under the valve, the handle containing the yoke supporting assembly for the clamp is fulcrummed so that the operator can physically raise the tube holder and clamp in abutting relationship with the ladle gate valve nozzle, and thereafter engage the toggle mechanism, and then remove the handle and yoke assembly with the toggle clamp securing the tube to the nozzle of the ladle gate valve. Since the collar ring is solid and the toggle biasing the clamp slot above it, the upper rim of the clamp bites into the collector nozzle and hangs the clamp and tube in place.

The method of the invention includes the above steps and, in addition, placing mortar in an excess amount on the annular collar top of the tube, and then clamping the same to squeeze out all of the excess mortar through the slotted portion of the clamp while closing the toggle.

It is a principal object of the present invention to provide a simple toggle clamp mechanism which can be remotely positioned to secure a tube to an existing ladle gate valve collector nozzle, and provided with separable means so that a force fit can be applied prior to the toggle action of securing the clamp, and thereafter all elements removed, all while the operator or operators are positioned a distance away from the ladle and not underneath the ladle.

Another object of the present invention is to provide a method for remotely securing a pour tube or extension to a ladle gate valve collector nozzle which is totally mechanical, and is provided with sufficient mechanical advantage so that two operators can promptly apply the extension tube while the ladle contains molten metal ready for teeming.

Still another object of the invention includes the method of applying sufficient mortar to seal the joint between the tube and the pouring nozzle so that some will escape and assist in providing a tight joint between the clamp and the ladle gate nozzle.

A further object of the present invention is to provide a tube clamp-on holder for remotely securing a tube to a nozzle which is inherently inexpensive to manufacture, which can be reused, and the more costly parts of which can be salvaged for purposes of rebuilding and remanufacture. A related object is to provide a construction, the parts of which can be common to several diameters of tube and nozzle sizes.

Yet another and important object of the invention is to provide a clamp-on tube holder and associated tube which permits securing the extension to a gate nozzle with broad tolerances which can accommodate the adverse conditions found in a mill where molten metal is being processed.

THE DRAWINGS

Further objects and advantages of the present invention will become apparent as the following description of an illustrative embodiment proceeds, taken in conjunction with the accompanying drawings in which.

THE METHOD

The method of attaching a clamp-on tube holder contemplates, not necessarily in the following order, the steps of:

1. Providing a toggle engaged clamp with a slotted portion biased by a toggle having a diameter when unclamped sufficient to engage the underneath portion of a collar on a tube.

2. Positioning a clamping bar for operating the toggle of the clamp and extending the bar a sufficient distance so that the clamping action can be undertaken at a position speced from the clamp and its associated tube.

3. Positioning a support yoke to engage the clamp at its underneath portion in a removable but non-rotatable relationship and extending the tube and clamp to a position immediately beneath the nozzle to which the tube extension is to be secured.

4. Fulcrumming the yoke support about a pivot point so that the remote end of its handle can be weighted downwardly thereby accomplishing a press fit engagement between the clamp, its carry tube, and the lower portion of the gate nozzle.

5. Clamping the toggle assembly on the tube clamp, removing the extensions from the clamp, and removing the yoke-like support thereby leaving the clamp and tube extension secured to the gate nozzle for teeming metal through the nozzle and the tube.

An additional preferred step in the assembly is to apply an excess of mortar between the gate nozzle and the upper portion of the tube which serves to seal the joint, and is squeezed out as the clamping takes place with the excess flowing in part to provide additional frictional resistance for insuring a tight clamp between the upper portion of the clamp and the gate nozzle exterior metal casing.

An additional desirable step is providing a toggle adjustment which can be actuated remotely by the handle which engages the toggle extension.

THE PREFERRED APPARATUS

Figure 1:
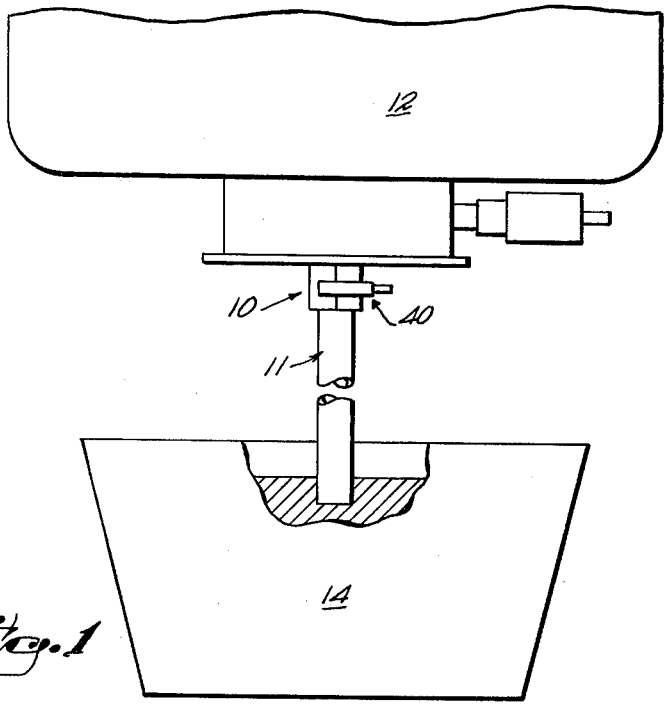
FIG. 1 is a partially diagrammatic view of a typical ladle and tundish which has been modified by a tube extension with a clamp-on tube holder illustrative of the present invention.

The tube holder 10 of the present invention, as noted in FIG. 1, engages a tube 11 which is secured beneath a ladle 12, and thereafter the tube 11 may be positioned for pouring into a tundish 14, the lower end of the tube optionally being submerged during the pour.

Figure 2:
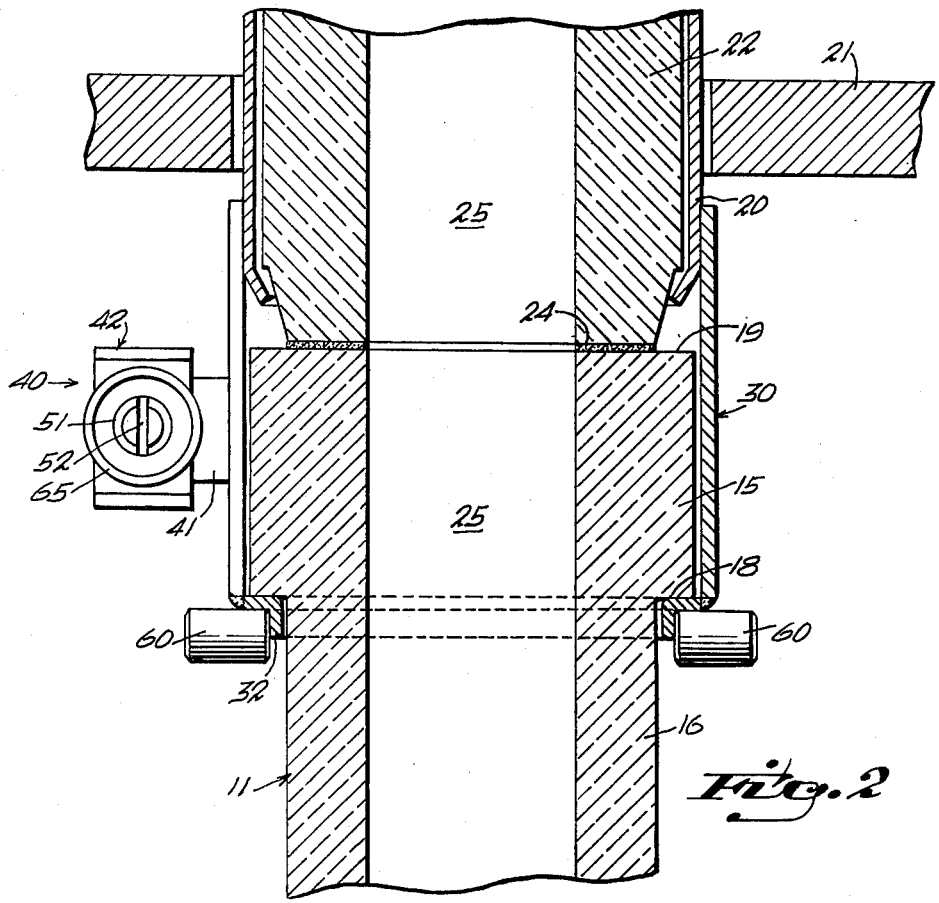
FIG. 2 is a transverse sectional partially broken, partially diagrammatic view showing the relationship between the tube, tube holder, and ladle gate nozzle.

Turning now to FIG. 2, it will be seen that the tube 11 has an upper tube collar 15 and a narrower tube body 16. An annular support 18 is provided at the lower portion of the tube collar 15, and a collar top 19 is provided for abutting sealed relationship with the gate nozzle 20 and specifically with the gate nozzle refractory 22 at the gate nozzle bottom 24. As will be noted in FIG. 2, the gate nozzle 20 extends beneath the frame bottom 21 of the ladle gate valve with which the tube is to operate. As shown in the instant relationship, the teeming opening 25 from the gate nozzle 20 is the same as the teeming opening 25 in the tube 11.

Figure 3:
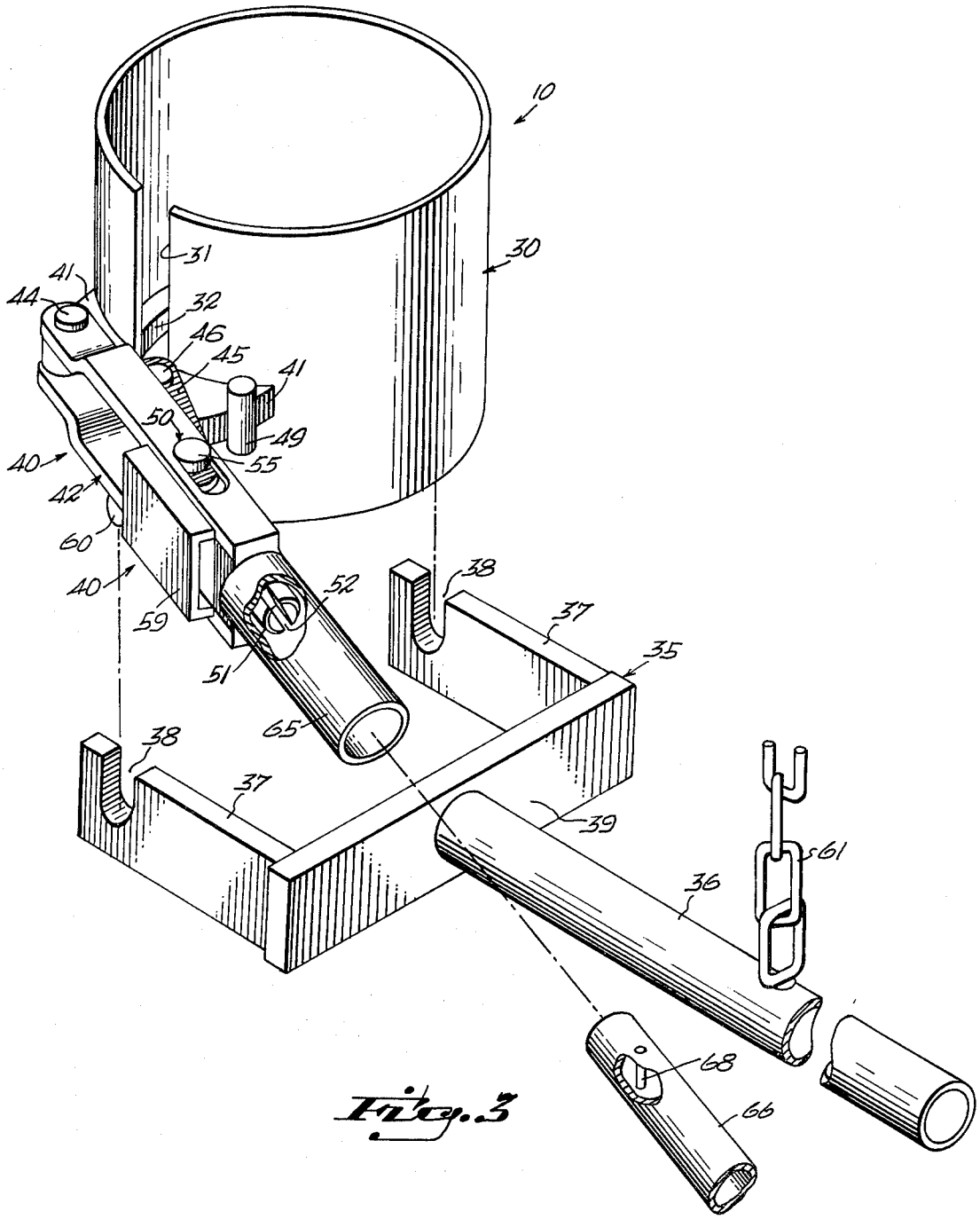
FIG. 3 is a perspective partially exploded view of the toggle and clamp, as well as the assembly yoke which is used to position the clamp and its associated tube for attachment to the ladle gate valve.

Turning now to FIG. 3, it will be seen that the tube holder 10 has as its basic element a tube holder band 30 provided with a slot 31. An uninterrupted collar ring 32 is positioned interiorly of the tube holder band 30 and, as noted centrally in FIG. 2, engages the annular support 18 of the tube 11 for carrying the same into position for attaching to the gate nozzle 20, and for retaining the same in teeming relationship thereafter.

The tube holder 10 is carried into the position generally shown in FIG. 2 by means of an assembly yoke 35, and its associated handle 36. The assembly yoke 35 has a pair of opposed legs 37, each of which terminates in opposed stirrups 38, the entire unit being assembled by securing the back 39 of the yoke 35 to the handle 36.

The toggle assembly 40 is positioned to bias the slot 31 in the band 30. The toggle assembly 40 is secured at one end to a mounting block 41 to which the toggle arm 42 is pivotally connected by means of toggle pivot pin 44. The clamping arm 45 is a pair of opposed arm members and secured to a clamping arm pivot 46. A second mounting block 41 is provided on that portion of the band 30 opposite to the mounting block 41 and includes a pivot stop 49.

Figure 4:
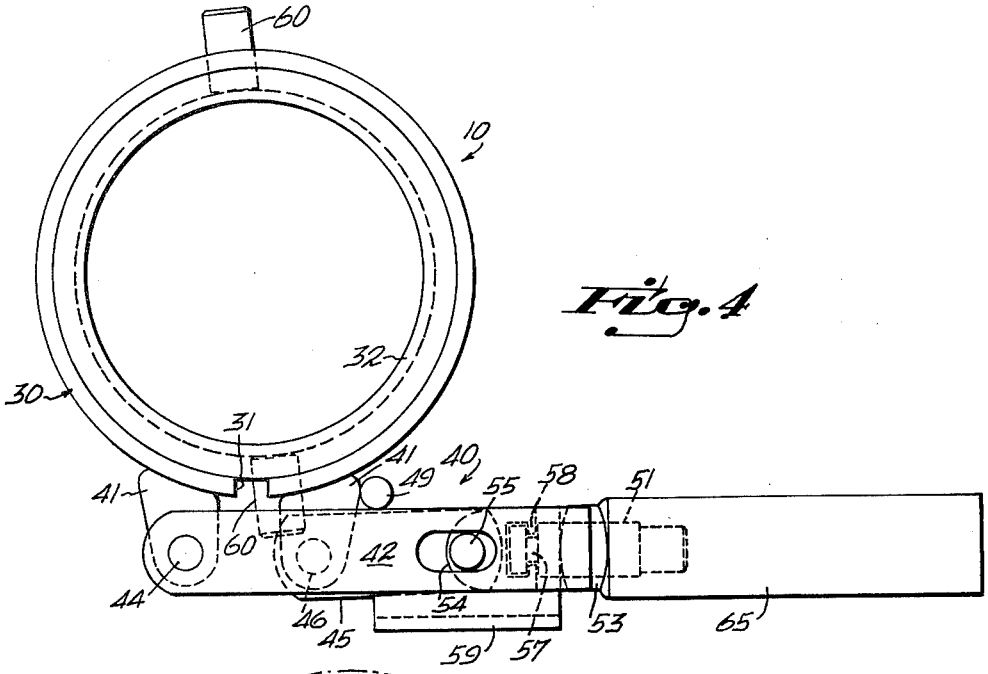
FIG. 4 is a top view of the clamp assembly.
Figure 5:
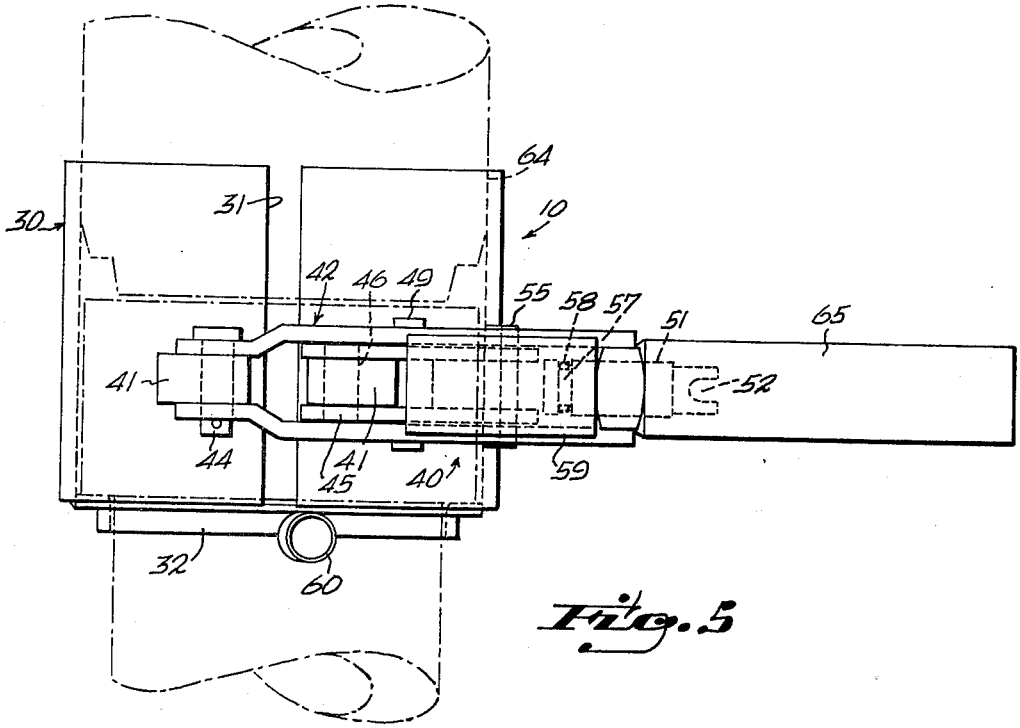
FIG. 5 is a front elevation of the clamp assembly.
Figure 6:
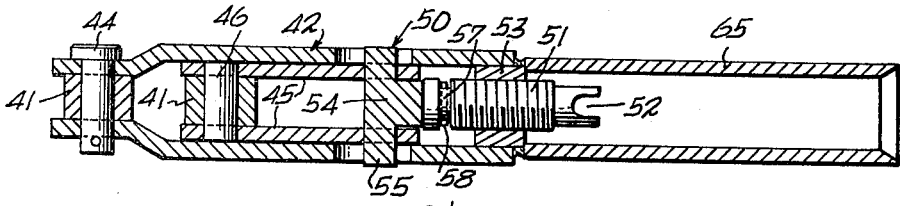
FIG. 6 is a longitudinal sectional view taken along section line 6—6 of FIG. 4 showing the interior portion of the toggle mechanism and its adjustable feature.

A pressure adjustment assembly 50 is activated by means of the threaded rod 51 which engages the adjustment bolt 53 secured interiorly of the toggle assembly 40. The threaded rod 51 has a collar 57 at its end opposite the adjustment slot 52. Centrally disposed in the toggle assembly 40 is the clamp arm adjustable load pivot assembly 54 having opposed extending clamp arm adjustable load pivot pins 55. The collar bar 58 extends in yoke-like fashion (see FIG. 4) and engages the collar 57 of the threaded rod 51 so that irrespective of the direction of adjustment applied through the slot 52, the centers between the pivot pins 44, 46, 55 can be adjusted and the toggle action adjusted. Because the toggle clamping action is at the lower portion of the split collar 30 and immediately above the fixed annular collar ring 32, the action of the toggle in squeezing the clamp is to convert it to a slightly conical configuration. This causes the upper rim of the tube holder band 30 to grasp the collector nozzle at its inner edge, particularly as shown at 64 in FIG. 5. The torsional action thus applied to the toggle assembly makes it desirable to apply a cover 59 secure to the upper and lower legs forming the toggle arm 42 at shown in FIGS. 4 and 5. When the assembly is fully clamped, as shown in FIG. 5, the collar ring 32 does not clamp on the tube itself, but rather supports it as a shelf. The balance of the mortar which is squeezed out in the interior portion of the tube holder band 30 seals the joint and also assists in strengthening the clamping action of the tube holder band 30. Upon removing the clamp to remove the tube, it will be appreciated that the tube hodler band 30 may lose its resiliency. As a consequence, the reversibility of the action of the bolt 53 and its collar 57 coacting with the collar bar 58 of the clamp arm adjustable load pivot 54 will forceably open up the clamp for the removal of the tube.

The entire tube holder 10 and tube 11 combination is moved into the position shown in FIG. 2 by means of the engagement of the assembly yoke 35 through its stirrups 38 with the stirrup pins 60 which extend substantially diametrically from the bottom of the tube holder band 30. As shown, a chain pivot 61 is secured to the handle 36 supporting the assembly yoke 35, and therefore an operator, by applying his weight at the remove end of the handle 36, can firmly raise the tube holder 10 to secure the collar top 19 of the tube 11 in abutting relationship with the gate nozzle bottom 24 as shown in FIG. 2. Thereafter, the operator can adjust the toggle assembly 40, and then manipulate the socket handle 66 to close the tube holder 10 and clampingly engage the same with the gate nozzle 20. The torsional effect of such action is resisted by the engagement of the stirrup pins 60 with the stirrup 38 of the yoke assembly 35. Thereafter, the socket handle 66, which includes a cross pin 68 for engagement in rod slot 52 is removed from the socket stub 65, and the assembly yoke 35 and its associated handle 36 lowered at their end portion to become free of the stirrup pin 60, and then the entire assembly is removed. While a chain 61 has been shown as the pivotal support for the handle 36, it will be appreciated that a pivot in the form of a rail extending upwardly from the operator's platform can be similarly used. Desirably the chain is secured to the ladle, although it can also be secured to any securing means vertically spaced from the position of the operator.

Although particular embodiments of the invention have been shown and described in full here, there is no intention to thereby limit the invention to the details of such embodiments. On the contrary, the intention is to cover all modifications, alternatives, embodiments, usages and equivalents of a clamp-on tube holder and method as fall within the spirit and scope of the invention, specification, and the appended claims.

What is claimed is:

1. The method of clampingly securing a tube to a gate nozzle from a position remote from the underneath portion of a ladle comprising the steps of:

providing a toggle engaged clamp with a slotted portion biased by a toggle having a diameter when unclamped sufficient to engage the underneath portion of a collar on a tube, positioning opposed clamping bars for operative effect at substantially diametrically opposed positions on the clamp and extending the bars a sufficient distance so that the clamping action can be undertaken at a position spaced from the clamp and its associated tube, positioning a support yoke to engage the clamp at its underneath portion in a removable relationship and extending the tube and clamp to a position immediately beneath the nozzle to which the tube extension is to be secured, fulcrumming the yoke support about a pivot point so that the remote end of its handle can be weighted downwardly thereby accomplishing a press fit engagement between the clamp, its carry tube, and the lower portion of the gate nozzle, clamping the toggle assembly on the tube clamp, removing the extensions from the clamp, and removing the yoke-like support thereby leaving the clamp and tube extension secured to the gate nozzle for teeming metal through the nozzle and the tube.

2. In the method of claim 1, the additional step of providing adjustment means in the toggle to vary the clamping effort and spacing.

3. In the method of claim 1, providing an excess amount of mortar on top of the upper portion of the tube, and squeezing the same out during clamping to thereby promote full mortaring of the joint and applying a portion of the mortar to frictionally assist the clamp in its engagement with the nozzle.

4. A clamp-on tube holder for holding a tube to a gate nozzle of a molten metal pouring ladle comprising, in combination, a slotted tube holder band, a toggle assembly biasing said band, whereby actuation of the toggle will press fit the band against and onto the lower portion of the nozzle, socket means on the end of the toggle for removably receiving a handle, and yoke engaging means in substantially diametrically opposed locations at the lower portion of said band whereby a yoke may engage the yoke engaging means to swing the clamp-on tube holder into position beneath a ladle and resist rotation when a handle is positioned in the socket means and actuates the toggle.

5. In the clamp-on tube holder of claim 4, a collar ring positioned interiorly of the band and at its lower portion to receive a tube and retain the same for transport into position beneath a nozzle and retain the same in teeming relationship therewith after being secured.

6. In the clamp-on tube holder of claim 4, threaded means, for adjusting the extent of throw of the toggle, and means in said handle for engaging the threaded means and adjusting the same while the toggle and tube holder band are in proximate spaced relationship to the gate nozzle.

7. In the clamp-on tube holder of claim 4, a yoke with two legs having stirrups at the remote portions of each leg positioned to receivingly engage the yoke engaging means of said band, and a handle extending from the yoke with means for pivoting the same.

* * * * *